US005176386A

United States Patent [19]

Simmons

[11] Patent Number: 5,176,386

[45] Date of Patent: Jan. 5, 1993

[54] ADJUSTABLE DYNAMIC TARGET SYSTEM FOR FIREARMS

[76] Inventor: Roger W. Simmons, 482 Carte Blanco, Upland, Calif. 91786

[21] Appl. No.: 789,948

[22] Filed: Nov. 12, 1991

[51] Int. Cl.[5] ..... F41J 7/00

[52] U.S. Cl. ..... 273/392

[58] Field of Search ..... 273/390, 391, 392, 378, 273/386

[56] References Cited

U.S. PATENT DOCUMENTS 157,335 12/1874 Lyon ..... 273/390 X 2,085,933 7/1937 Vaughan ..... 273/392 X 4,588,194 5/1986 Steidle et al. ..... 293/391

*Primary Examiner*—William H. Grieb

*Attorney, Agent, or Firm*—Lewis Dalgarn

[57] ABSTRACT

The adjustable, dynamic target system has an impact resistant target silhouette mounted to the upper end of a shaft journal for rotation about a horizontally supported axle. The lower end of the shaft carries the counter weight that can be adjustable positioned along the lower end of the shaft to produce varying dynamic affects according to the impact force of projectile and the skill of the marksman.

5 Claims, 1 Drawing Sheet

ADJUSTABLE DYNAMIC TARGET SYSTEM FOR FIREARMS

BACKGROUND OF THE INVENTION

The present invention relates to an adjustable dynamic target system for use with firearms which provides a target that moves when struck and which can be adjusted to provide a selectable dynamic response to firearms with varying caliber and power for shooters with diverse levels of skill.

With the increasing use of body armor, such as bullet proof vests, by criminals and military forces, the head and neck areas remain as practically the only unprotected vital body areas where a gunshot will inflict a disabling wound on an assailant or enemy combatant during a deadly confrontation. For this reason, law enforcement and military agencies have in recent years placed increased emphasis on training their personnel to aim at these vital areas when faced with a life threatening situation.

In the past, firearms training for law enforcement and military personnel has relied upon conventional targeting systems where a target outline of the upper or trunk portion of the human body provides a central aiming point or bullseye in the middle of the chest area. The expertise of an individual marksman was determined by actually inspecting bullet holes made in the target based on their proximity to the central aiming point. In some specialized training environments, dynamic targets were used where a panel in the shape of a human silhouette was hinge mounted at the bottom with a releasable latch mechanism to provide a "knock down" type action when the target was hit, which caused the latch to release allowing the upright target to swing down to a horizontal position. After each hit, the target had to be returned to and latched in its upright position either manually or by expensive automatic reset systems.

With such "knock down" type target systems, the bullet would have to strike in an impact area at some minimum distance from the hinge to create enough torque to overcome the restraining force of the latch mechanism. However, this minimum distance between the impact point and hinge varied depending on the force of the projectile which meant that, with smaller caliber, less powerful firearms, bullets would have to strike higher on the target to overcome a given latch restraining force. Although the restraining force of the latching mechanism might be varied to suit projectiles of different calibers and power, that was for the most part impractical because, given a particular latch setting, frequent adjustments were needed to compensate for wear on the abutting contact surfaces of the mechanism.

SUMMARY OF THE INVENTION

The present invention provides a simple and inexpensive firearms target system having a dynamic "knock down" type of action with a head and neck area silhouette target, wherein the system is readily adjustable to suit firearms of different caliber and power or to provide selectable repetitive "pop up" target operation that can be varied to match the varying skills of individual marksmen.

In its preferred form, the target system of this invention consists of a flat target plate of impact resistant material, such as case hardened steel, mounted at the outer end of the upward extension of a vertical elongated shaft that is journaled at an intermediate point along its length for rotation in a vertical plane about a horizontal axis of rotation. A counterweight is adjustably positioned on the lower extension of the shaft that extends downwardly from the horizontal axis of rotation so that the upper shaft holding the target plate is normally maintained in an upright position.

When the target plate is struck by a bullet, the projectile force is imparted to the upper end of the vertical shaft to create a torque that overcomes the downward force of the counterweight, thus causing the upper end of the vertical shaft to rotate towards a downward position to provide a "knock down" type of target action indicative of a hit. The extent of downward movement produced by a bullet of a particular caliber and power can be adjusted simply by moving the counterweight to different positions along the length of the lower shaft extension. For example, by positioning the counterweight upwardly, more movement will result due to a given impact force on the target, which is desirable for lower caliber, less powerful weapons. Conversely, positioning the counterweight further down results in less movement to suit higher caliber, more powerful weapons.

For more expert marksmen, the counterweight can be adjusted upwardly so that, when the target plate is struck, a complete rotation about the horizontal axis will result to produce a repetitive "pop up" type action for repetitive synchronized firing exercises. In this mode of operation, repeated hits on the target produce faster rotation thus increasing the rate at which the target appears and disappears, while decreasing the duration of each appearance so that the degree of difficulty increases to match the greater proficiency of more expert marksmen. Also, in this mode of operation, the counterweight can be positioned to control the speed of rotation to suit a given rate of fire.

DETAILED DESCRIPTION

Figure 2:
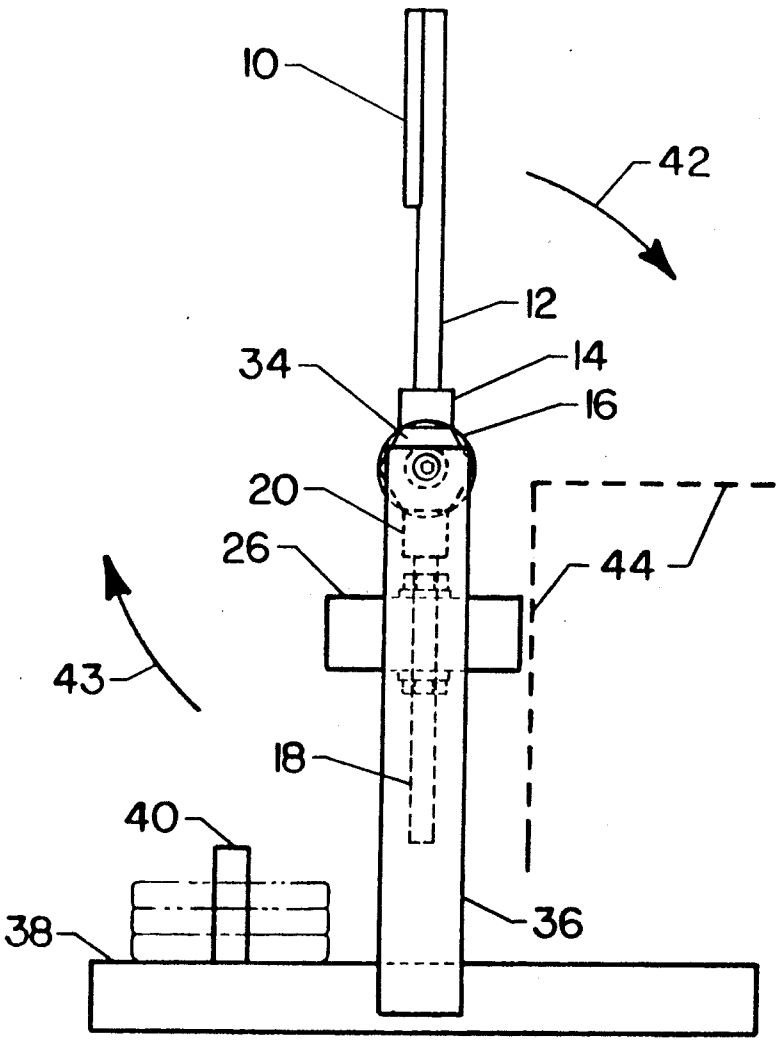
FIG. 2 is a side elevational view of the preferred form of the invention shown in FIG. 1 with interior elements shown in dashed outline.
Figure 1:
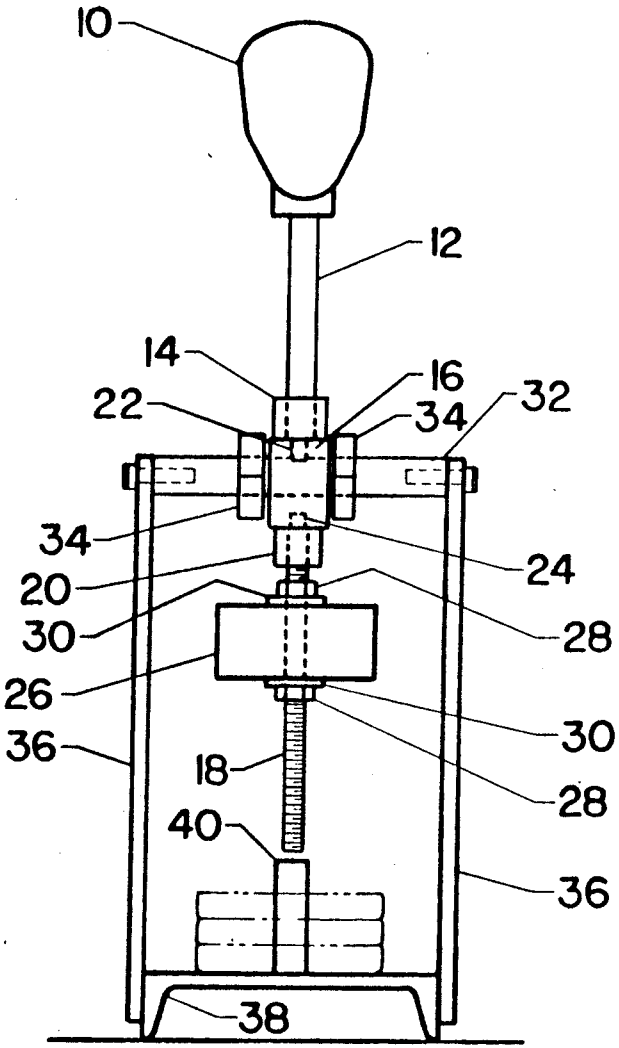
FIG. 1 is a front elevational view of preferred form of the invention.

A target 10 consists of a flat plate of impact resistant material, preferably case hardened one half inch steel plate, cut in the outline of a human head and neck area (or other desired shape). The target plate 10 is securely affixed, preferably by welding, to the top portion of a vertical upper shaft 12. The lower end of the upper shaft 12 is securely held in an upper sleeve-like receptacle 14 affixed or formed on one side of the cylindrical bearing 16. The inner end of the shaft 12 is preferably welded securely in place to prevent axial rotation of the upper shaft and target plate.

Similarly, a lower vertical shaft 18 is securely affixed in a lower sleeve-like receptacle 20 affixed or formed on the opposite or underside of the cylindrical bearing 16. In this case, the lower shaft 18 may be secured in its sleeve-like receptacle 20 either by welding or, if desired, by threading the upper end to engage interior threads provided in receptacle 20 so as to facilitate disassembly into smaller components.

Each of opposing upper and lower sleeve-like receptacles 14 and 20 in the preferred embodiment consist of two inch long sections of steel tubing having a five eights outer radius and a one quarter inch inner radius with one end being machined to fit snugly against the curved outer surface of the cylindrical bearing 16 to which they are firmly affixed by welding. In its preferred form, which is intended for heavy caliber weapons, the upper shaft 12 consists of a 20 inch long section of five eights diameter cylindrical steel stock the lower end of which is machined down to fit into a shallow bore that is drilled axially into the cylindrical bearing in the center of the sleeve like receptacle 14. Similarly, the upper end of the lower shaft is machined down to fit into a shallow bore 24 on the opposite side of the cylindrical bearing 16 along the center line of the lower sleeve like receptacle 20. With the ends of the upper and lower shafts 12 and 18 inserted into the respective bores 22 and 24, at lease some of the lever forces produced at the inner ends of the shafts are transmitted to the cylinder itself, thus relieving strain on the wells that affix the receptacle 14 and 20 to the outer surface of the cylindrical bearing 16.

The lower shaft 18 preferably consists of a threaded five eighths inch diameter steel stock that is threaded along substantially its entire length. A counterweight 26, preferably in the form of a solid block of steel or other heavy impact resistant metal is drilled through its center to provide a central opening through which the lower shaft 18 can be inserted. Hex nuts 28 having interior threads to engage the threads on the lower shaft 18 are positioned on opposite sides of the counterweight 26 together with flat metal washers 30 to hold the counterweight 26 at a selected position along the length of the lower shaft 18.

The cylindrical bearing 16 is journaled for rotation about a horizontal cylindrical shaft 32 between a pair of longitudinal stops 34. In the preferred embodiment, the horizontal shaft 32 consists of a one and one eighth diameter steel round which should have a smoothly machined surface at least along the portion between the two longitudinal stops 34. Likewise the inner surface of the cylindrical bearing 16 is machined to provide a close slip fit with the surface of the shaft 32, and may be provided with one or more parts (not shown) for lubrication. In the preferred embodiment, the longitudinal stops 34 may consist simply of one and one eighth inch standard hex nuts soldered or otherwise held in place on the cylindrical shaft on either side of the bearing 16.

In its preferred form as shown in the drawings, the target system is designed as a "stand alone" portable unit with the horizontal shaft 32 being held between the upper ends of two vertical arms 36 that extend upwardly from a base assembly 38. In its simplest form, the base assembly 38 may consist of an eight inch wide section of steel channel approximately twenty-one inches long with the upwardly extending vertical arms 36 welded on either side at approximately its midpoint. Each vertical arm 36 consists of one half inch thick rectangular steel bar which is two inches wide and approximately forty-two inches long with a 7/16 inch diameter hole drilled horizontally through the upper end of each arm to receive a threaded three eighths inch cap screw about one and a half inches long, that extends through the hole in the arm 36 to engage the interior threads of tapped holes drilled axially into either end of the horizontal shaft 32. Tightening the cap screw at either end draws the vertical arm into contact with the adjacent end of the horizontal shaft 32. An upright metal stanchion 40 is affixed, preferably by welding, to the center of the forward half of the base assembly to receive circular weight plates of the type used in barbell exercise equipment that are stacked on the shaft 40 to stabilize and prevent movement of the mounting assembly during use.

In operation, a bullet impacting the front surface of the target plate 10 imparts a backwardly directly torquing force to the top of the upper shaft 12 as shown by the directional arrow 42 in FIG. 2. This causes the upper shaft to swing backwards and downwards in a rotational arc about the central axis of the cylindrical bearing 16 as shown by the directional arrow 43. As the upper shaft 12 down and back, the lower shaft 18 moves and forward carrying the counterweight 26 which produces a counterforce resisting further rotational motion of the shafts. The amplitude of the countertorque produced is proportional to the horizontal displacement of the counterweight from its vertical alignment below the cylindrical bearing 16 and, for a given angular displacement of the shaft 18, this horizontal displacement is proportional to the distance between the center of gravity of the counterweight 26 and the rotational axis of the bearing. Thus the restraining force of the countertorque can be increased by positioning the counterweight 26 further down along the lower shaft, or can be decreased by moving the counterweight 26 further up.

Moreover, the dynamic action produced by the target system can be varied by adjusting the position of the counterweight 26. For example, for simple "knock down" effect, the counterweight 26 would be positioned on the lower shaft 18 so that the impact of a bullet of a given caliber, weight and speed would cause rotation of the bearing to a point where the shafts would be approximately horizontal so that the target plate 10 would momentarily disappear and then reappear when the counterweight 26 restores it to the upriqht position. For more expert marksmen, the counterweight 26 could be moved upward on the lower shaft to reduce the counter torque so that a single hit on the target plate 10 would produce at least a hundred and eighty degree rotation of the shaft and bearing mechanism so that the counterweight 26 would move past a position directly above the cylindrical bearing 16 to complete a full rotation. As the target plate 10 swung around to its original upright position, another bullet hit would increase the rotational momentum to bring the target plate 10 into its upright position quicker than during the previous rotation. Subsequent hits would gradually increase the rotational speed to the point where the target plate 10 would appear at progressively briefer intervals and for shorter periods until the skill of the marksman was over matched. When this occurred, subsequent misses would result in gradual decrease of the rotational speed so that the intervals between successive target appearances would automatically adjust to the prevailing skill of the marksman, thus permitting his level of skill to be gauged by the sustained rotational speed of the target.

On the other hand, the basic free rotational operation of the system could be modified for simple "knock down" action by placing stops to limit the backward and downward motion of the upper shaft and arrest the return movement when the target plate 10 reached its fully upright position. This simple "knock down" action could be facilitated simply by placing a stationary external obstruction with horizontal and vertical contact surfaces in the approximate position shown by the broken lines 42 in FIG. 2. Alternatively, such stops could be provided by affixing a post (not shown) to the center of the back portion of the base assembly 38 to be horizontally aligned with the plane of rotation of the shafts 12 and 18 so that the upper shaft 12 would contact the upper surface of the post and moving downward and the counter weight 26 would engage the vertical surface of the post upon being restored to its vertical position. Also a variety of conventional cam and stop mechanisms might be devised with appropriate modifications of the bearing 16 and the horizontal axial shaft 32.

As may be appreciated from the foregoing description, the dynamic target system of this invention provides a simple, inexpensive, but highly versatile dynamic firearms target to suit a variety of needs. It will be appreciated that various changes and modification may be made in the basic design features disclosed in connection with the preferred embodiment without departing from the spirit or scope of the invention as set forth in the appended claims.

What is claimed is:

1. An adjustable, dynamic target system comprising:

an axle member supported in the horizontal position;

a cylindrical bearing rotatable about said horizontally supported axle;

upper and lower elongated shafts rigidly affixed to and extending outwardly from opposite sides of said bearing;

a target plate affixed to said upper shaft at the outer end; and a counterweight movably mounted on said lower shaft to be adjustably positioned along its length in accordance with the force of the projectile striking the target to produce a predetermine dynamic action, whereby a projectile striking the target plate causes said bearing and shafts to rotate about said horizontal axial in a manner determined by the relative positioning of the counterweight along the length of the lower shaft.

2. The dynamic target system of claim 1 wherein:

said lower shaft is threaded along its length; and wherein a pair of internally threaded nuts for engaging the threads on said lower shaft to positioned one above and one below the counterweight to hold the counterweight at a preselected position along the length of said lower shaft.

3. The dynamic target system of claim 1 further comprising:

a mounting assembly consisting of an elongated flat base member; and two upright support arms for engaging the ends of said horizontally supported axle at a height above the base to permit full rotational movement of the upper and lower shafts about said axle.

4. The dynamic target system of claim 3 further comprising:

an upright stanchion affixed to said base member at a location forward of said support arts adapted to receive weight plates for stabilizing the base system against movement due to projectile impact.

5. The dynamic target system of claim 4 wherein each of the aforementioned elements is formed of impact resistant steel.

* * * * *